US005081986A

United States Patent [19]

Cho

[11] Patent Number: 5,081,986

[45] Date of Patent: Jan. 21, 1992

[54] MASSAGING AND COMBING HELMET FOR INSOMNIA

[76] Inventor: Nam I. Cho, 5 Wayside La., Ashland, Mass. 01721

[21] Appl. No.: 578,802

[22] Filed: Sep. 7, 1990

[51] Int. Cl.[5] ..... A61H 7/00

[52] U.S. Cl. ..... 128/62 R; 128/63; 128/58; 128/60

[58] Field of Search ..... 128/62 R, 24.3, 24 R, 128/56, 58, 60, 61, 63, 36; 2/171.6, 171.7, 171.8, 171.2, 171.1; 446/27, 433

[56] References Cited

U.S. PATENT DOCUMENTS

| | | | |
|---|---|---|---|
| 2,051,366 | 8/1936 | Catron | 446/27 |
| 2,247,440 | 8/1938 | Hempel | 128/63 |
| 2,467,007 | 4/1949 | Boyd | 128/52 |
| 2,566,600 | 11/1949 | Colon | 128/52 |
| 3,494,070 | 5/1962 | Lemelson | 446/433 |
| 4,078,557 | 3/1978 | Spencer | 128/56 |
| 4,765,316 | 8/1988 | Marshall | 128/36 |

FOREIGN PATENT DOCUMENTS

| | | | |
|---|---|---|---|
| 2120099 | 11/1983 | United Kingdom | 128/52 |

*Primary Examiner*—Robert A. Hafer
*Assistant Examiner*—David J. Kenealy
*Attorney, Agent, or Firm*—Richard C. Litman

[57] ABSTRACT

A massaging helmet contains an endless belt which rubs the wearer's head with belt areas of various textures. The belt runs over two rollers located inside the helmet near the forehead and nape. An electric motor and batteries power the belt, which rubs the scalp from front to back. The rear roller is adjustable for tensioning the belt. The belt surface, of soft plastic, has both an embossed area to mimic the human hand, and another area with rows of upright plastic fingers which comb the hair.

11 Claims, 2 Drawing Sheets

MASSAGING AND COMBING HELMET FOR INSOMNIA

FIELD OF THE INVENTION

The present invention relates to head-massaging machines to relieve insomnia.

DESCRIPTION OF THE PRIOR ART

Head massage for relaxation is very old. Primitive man, lacking implements, used the palms of the hands for head massage, and fingers to comb the hair. Head massage and grooming are practiced by all peoples and also by all animals related to man, such as the baboons who spend much time grooming one another's heads to remove insects and dirt. Head massage is used by parents to sooth and reward their children; the related act of head patting indicates approval or affection to children and adults both. The universal human use of these actions probably indicates that they are genetically based.

Because head massage induces warm and contented feelings, it is an effective relaxation promoter. Because it is relaxing, it is also effective against insomnia.

Insomnia is a problem for many people, especially those in industrialized areas where there is little physical contact and much stress from noise, pollution, social demands, and anxiety. Most insomniacs, however, do not have access to nightly head massage by another person.

Rubbing and combing of the scalp and hair can be aided by machines. Combs and brushes are simple examples of such machines. More complex electric brushing and massaging devices are common today.

Various head massaging devices have been disclosed in various patents. Many inventors have aimed to promote scalp health rather than relaxation, and some have included vacuums and hot air in addition to simple massaging pads or rubber fingers.

M. E. Koehler, in U.S. Pat. No. 2,103,949, shows a helmet having rubber massaging fingers on the inside, an air sealing diaphragm like that of a shower cap around the edge, and an air valve at the top. Handles on the outside of the helmet are used to manipulate the helmet to both massage the scalp and create a partial vacuum inside the helmet. The helmet is intended to promote scalp health.

Marshall, in U.S. Pat. No. 4,765,316, discusses another vacuum and massage helmet, but his helmet is vibrated and evacuated by respective electric motors. The vacuum is maintained by the combination of a rigid impervious helmet and a head gasket.

Another U.S. patent of Marshall, U.S. Pat. No. 4,469,092, again teaches a vacuum helmet, and includes an electrically vibrated inner pad, with rubber fingers contacting the scalp.

Canela, in U.S. Pat. No. 4,807,604, describes a helmet with water passages adapted to connect to a massaging shower head through a flexible hose. Pressure pulsations travel to the scalp through the passages.

Sato, in U.S. Pat. No. 4,744,350, discloses a massaging roller studded with rubber fingers on the outside, resiliently mounted in a handle. The device is intended to be rubbed on the head.

Ramseyer, in U.S. Pat. No. 4,787,372, shows a massaging helmet divided into two parts, a rear carapace and a mask. Both are of semi-rigid material. They are fastened into position around the user's head with Velcro straps, and are capable of limited independent movement. An electric motor mounted on the carapace at the top of the head is connected to an eccentric crank. The crank is tied to the mask part with cords. When the motor is powered, the mask is moved relative to the carapace and massaging action takes place.

Schamblin, in U.S. Pat. No. 3,481,326, combines a helmet, an electric vibrator to vibrate the helmet as a whole, and a hot air source to blow hot air through a tube, into the helmet, and over the scalp.

Wessel, in U.S. Pat. No. 4,023,567, teaches the use of a long flexible belt having handle rings at either end, a brush on one side of the belt, and rubber fingers on the other side. The belt is not mounted or powered, but is rather a two-hand manual tool.

Alonso, in U.S. Pat. No. 3,716,048, discloses a semi-spherical double-walled helmet with an electric motor and reduction gearing in a housing at the apex of the helmet. The gearing drives a shaft which passes through to the space between the outer and inner helmets. The shaft is connected to and drives a revolvable rigid semi-spherical shell located in bearings within the space between the helmet walls. Rubber fingers are press-fitted into holes through the inner shell of the helmet; being rubber, they are capable of limited angular movement about the hole. These fingers each have a nylon tip on the end projecting into the space between the helmet walls. The tips engage and ride in undulating grooves embossed on the movable shell. As the shell revolves, the tips are forced to move up and down by the grooves. The up and down motion is conveyed to the rubber fingers on the inside of the helmet, which massage the scalp.

None of the above inventions and patents, taken either singly or in combination, is seen to describe the instant invention as claimed.

In many cases, these devices are obviously not intended for relaxation. If a massaging helmet is to be used to fight insomnia and to promote relaxation, it should be usable is any position (especially while reclining), quiet, comfortable, and perhaps most importantly, it should mimic massage by the human hand.

None of the above devices is seen to fulfill these requirements.

In addition, none of the above devices employs more than one mode of head massage. A human massager of course will not vibrate his or her fingers in the same repetitive pattern, but will vary the motions, perhaps combining rubbing by the palm with combing by the fingers, and so on. The above devices thus do not mimic human contact, which means that they are less effective in promoting relaxation.

Moreover, a human would tend to use larger sweeping motions rather than very short stroke, high frequency, to and fro vibrations. Such short stroke, high frequency motions are easily produced by machinery but are not natural for humans; they are little used in human massage. Thus, again, the above devices which employ unnatural motions do not mimic the human touch and so do not promote relaxation.

Accordingly, one object of the present invention is a head massaging helmet which mimics the human touch.

Another object is a massaging helmet which will combat insomnia by promoting relaxation.

A still further object is a massaging helmet which employs more than one mode of massage and yields more than one sensation.

Yet another object is a massaging helmet which is comfortable to wear in bed or in various places without needing connection to a wall socket, vacuum pump, hot air blower, or other inconvenience.

A final object is a massaging helmet which has a massaging force adjustable for various users.

These and other objects of the present invention will become readily apparent upon further review of the following specification and drawings.

SUMMARY OF THE INVENTION

The present invention is a helmet for massaging the scalp to promote relaxation and gain relief from insomnia. It contains a flexible belt which is passed over the scalp from front to back by means of rollers driven by an electric motor powered by batteries contained in the helmet.

The belt has teeth or ridges on the inside to mesh with teeth on the electric motor drive roller. On the outside surface of the belt are two regions which sequentially massage the scalp as the belt moves around and over the head. One region, approximately ⅓ of the belt length, is soft embossed plastic to simulate rubbing by the palm of the hand. The remainder of the belt has fingers or bristles about 1 centimeter long to comb the hair and rub the scalp.

The helmet has a semi-rigid headband ring on which are mounted the rollers, motor, and batteries. A rigid cover piece with ventilating holes is hinged to the headband ring. It opens to uncover the working parts, and closes to protect them in use. Fabric straps with Velcro are used to secure the helmet to the head.

An on/off switch is provided. If the user falls asleep with the belt moving and exhausts the batteries, they can be recharged. The batteries are designed to power the belt for about 30 minutes.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
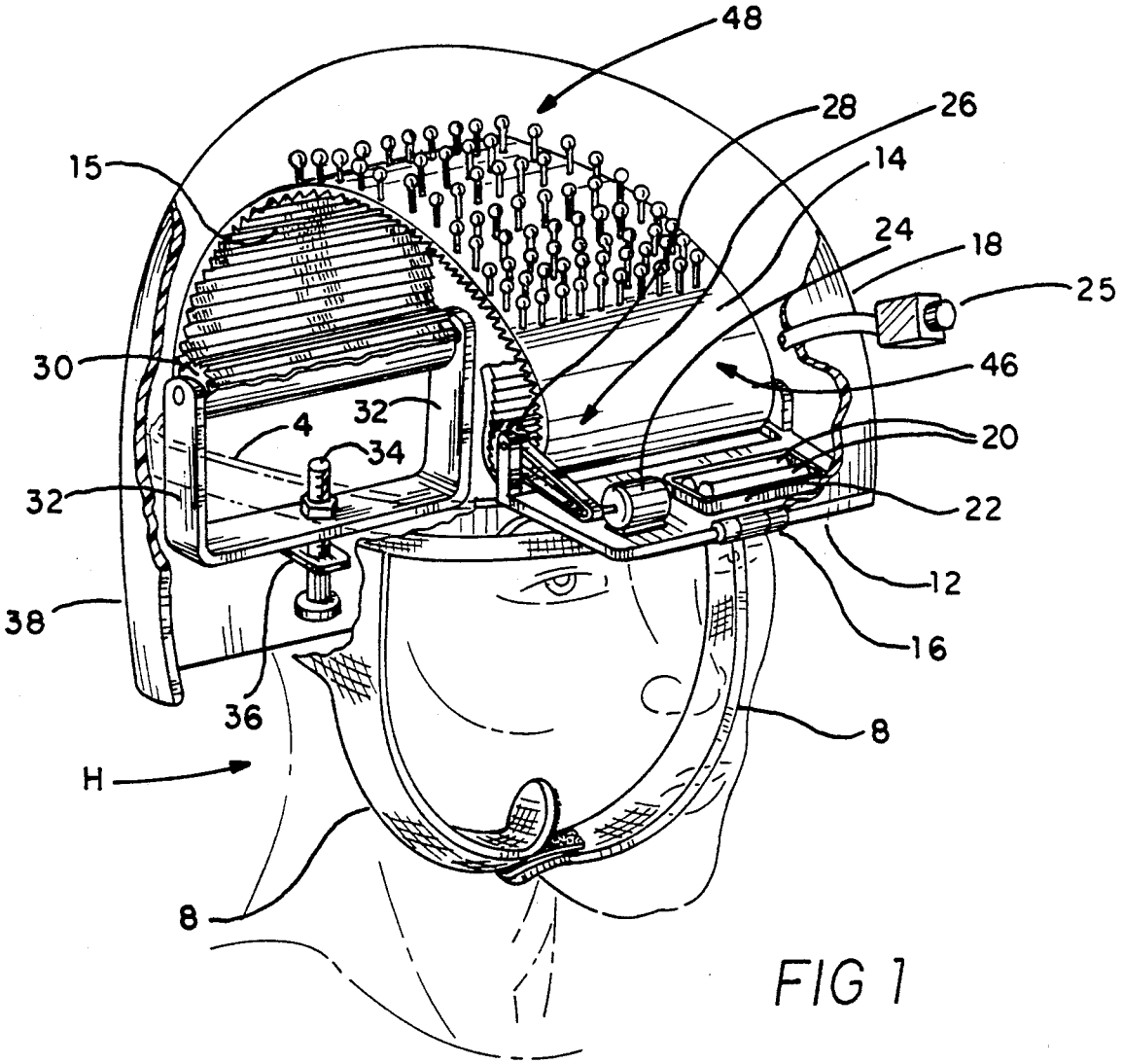
FIG. 1 is perspective cutaway three-quarters top view of the helmet showing the belt, adjustments and workings.

The inside parts of the present invention are shown in FIG. 1. The massaging helmet 2 presents a shell or carapace 18 having a forward edge 18*a* and rear edge 18*b*, with the shell joined to a ring 4 which encircles the head H of the user. (The head H is shown in phantom view in FIGS. 1 and 2.) The ring 4 connects the other parts and serves as a frame. The ring 4 may be made of strong plastic or other suitable material. It is shown in partial phantom view in FIG. 1.

Figure 2:
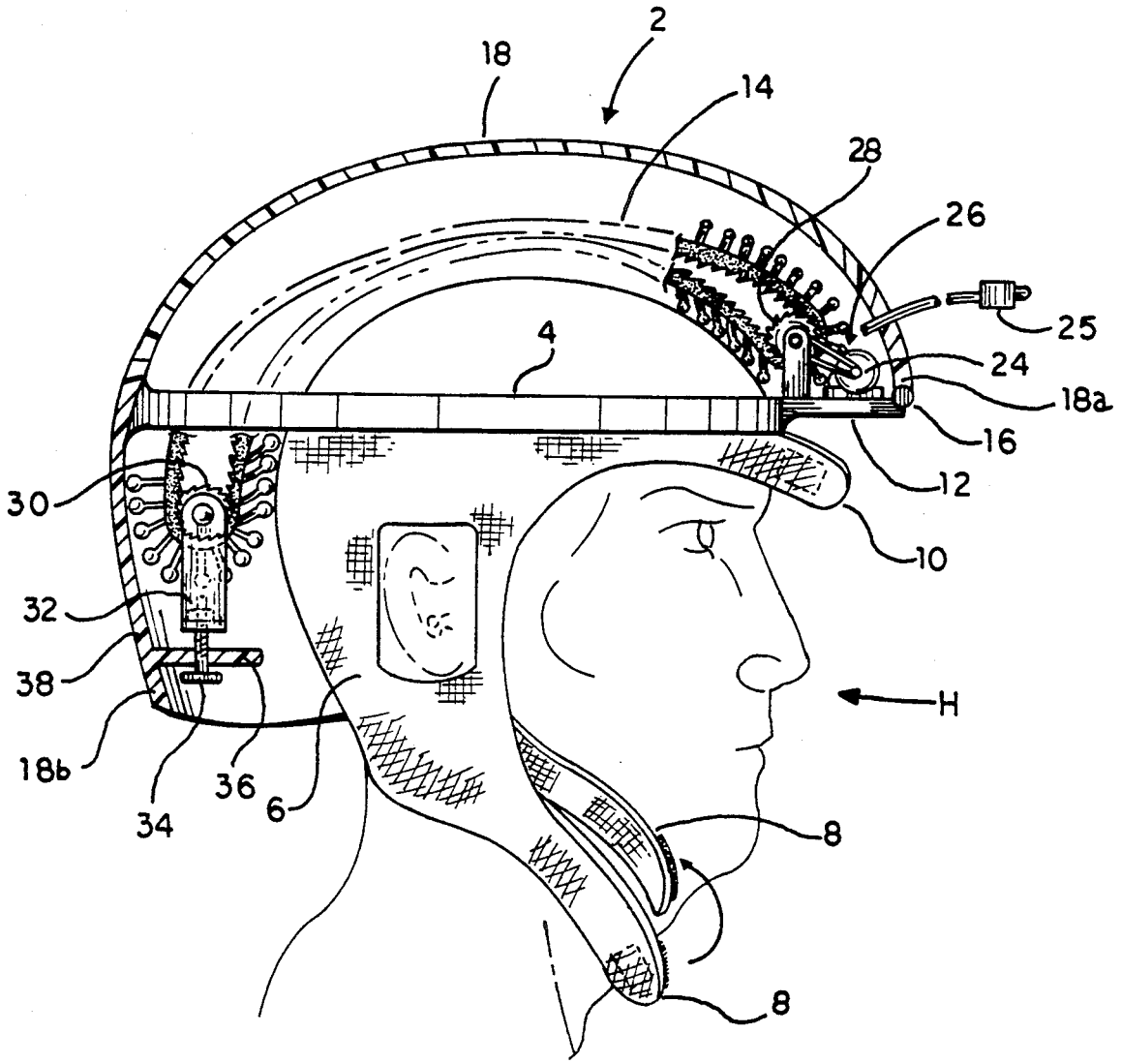
FIG. 2 is side plan view of the helmet on a user.

The lower edge of the ring adjacent the ear of the wearer, as shown in FIG. 2, has nylon cloth flaps 6 extending down to form the tabs 8 of a chin strap, and extending forward to form the tabs 10 of a headband. These latter elements provide retention or stabilizing means to prevent the ring and helmet parts attached to it from moving up and away from the wearer's head H when fastened and during operation of the apparatus. The tabs 8 and 10 may be joined with buckles, snaps, or by hook and fabric fasteners such as Velcro.

At the dorsal end of the ring near the middle of the forehead is a visor 12. This visor may be molded as one piece with the ring, or attached to the ring by rivets or the like. The visor 12 serves as a platform to hold the motor drive for the belt 14, and also contains a hinge 16 joining it to the carapace 18 which swings up to expose the motor drive.

The motor drive consists of batteries 20 in a battery holder 22, a DC motor 24, pulley drive 26, and front roller 28 around which is disposed the flexible, endless belt 14. The visor 12 may be molded to incorporate supports for these parts. The electrical parts are connected by wires inside the helmet (not shown). The motor is controlled from outside the helmet by a switch 25. The pulley drive 26 has a ratio such that the linear speed of the belt 14 is about 3 centimeters per second.

The front roller 28 preferably has transverse ridges on its surface to mesh with mating ridges on the inside surface of the belt 14. These ridges provide a positive grip.

The belt 14 is endless, and is disposed around both the front roller 28 and the rear roller 30. The rear roller 30 is similar to the front roller but lacks a drive. The rear roller 30 rides in a bracket 32, in which it is free to rotate. The bracket 32 moves up and down to provide varying pressure of the belt 14 against the head H of the user. The bracket is urged upward by tension in the belt 14; to urge it oppositely, the bracket has a threaded hole in its center. The threaded hole engages a tensioning screw 34 which passes through an unthreaded hole in a boss 36 on the inside surface of the back plate 38. Turning the tensioning screw 34 varies the maximum height of the bracket 32 and the roller 30. Thus the helmet is kept on the head H of the user and a comfortable tension may be set in the belt 14.

The back plate 38 may also be made of plastic. It may be either molded integrally with the ring 4 or attached with rivets, glue or the like. The boss 36 may be molded into the back plate 38.

The carapace 18, also preferably of plastic, may have ventilation holes to admit air to the scalp. It swings up on the hinge 16 which joins it to the visor 12. This allows access to the internal parts for changing batteries, repairs, and so on. The carapace 18 is secured to the ring 4 or to the back plate 38 by latches on either side of the helmet (not shown).

The belt 14, which is about 10 centimeters wide, is molded of soft plastic. A fabric core is in the center for strength. The plastic of which the belt is molded should have a low coefficient of friction because the inside surface of the belt rubs against itself in the region which is between the front and rear rollers and above the head H. Low friction is especially important because of the teeth or transverse ridges on the inside surface of the belt 14. (The ridges mate with longitudinal grooves in the rollers to provide non-slipping drive of the belt.)

To reduce the friction where the medial span of the belt inside surfaces rub against one another in the region above the head H, and at the same time to assure positive grip for driving by the front roller 28, the transverse ribs or ridges 41 on the belt inside surface 15 should have the form (in cross section, or at the edge) of triangles. That is, the ridges resemble ratchet teeth. These ridges are detailed in FIG. 3, which shows a portion of one edge of the belt 14. Each triangular ridge has one side 42 perpendicular to belt surface and the other side 44 inclined at an acute angle. The front roller 28 should have ridges or grooves of the same dimensions, angles and spacing to mate with the belt.

Figure 3:
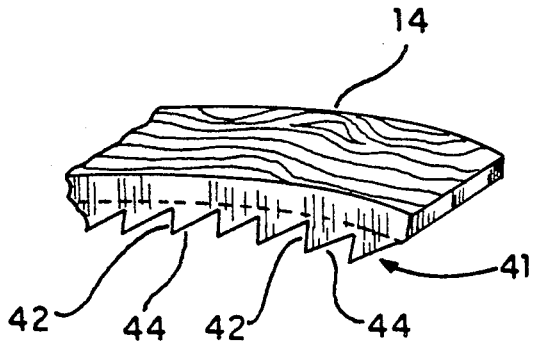
FIG. 3 is a detail drawing showing an edge of the belt with drive ridges.

The ridges must be aligned to the rotation of the front roller 28, which is clockwise when seen from the user's right side (as in FIG. 2), to cause the belt 14 to rub the head H from front to back. As seen from the right, the belt ridges should have the inclined face of each ridge on the right on the upper part of the belt, and on the left on the lower part. FIG. 3 shows the upper part from the same angle as in FIG. 1.

With this orientation of ridges and direction of motion, the inclined faces 44 of the upper and lower parts of the belt meet above the head H while the belt 14 is in motion, rather than the perpendicular faces 42. Meanwhile the front roller ridges' perpendicular faces bear on the similar perpendicular faces of the belt for positive drive, as shown in FIGS. 1 and 2.

The rear roller 30 may omit the ridges, as it does not drive the belt. However, the rear roller 30 may also be identical to the front roller 28, as shown in the figures, for simplicity and economy.

The outer surface of the belt is molded with two differently textured areas, as shown in FIG. 1. The first area 46 is embossed with a pattern of small ridges or undulations resembling the human palm. This occupies about one third of the length of the belt, or about 14 centimeters. The other area is the comb area 48, which is about 28 centimeters long. It contains a multitude of upright fingers or rods. These fingers have small ball ends or rounded ends for comfort (such as are found on certain hair brushes). Preferably, they have a length of 1 centimeter and a shaft diameter of 1.5 millimeters, and are spaced half a centimeter apart.

The actions of the two areas on the scalp are dissimilar. The embossed area rubs, and the other area combs. Thus two different and alternating sensations are produced by the two areas of the belt. Plastic of differing consistencies may be used for the two areas.

As with the inner surface of the belt, the outer surface should have a low coefficient of friction for rubbing the head. The plastic should also be soft to mimic the human palm.

Belts of various consistencies may be mounted to the helmet. For the bald or people with thin hair, softer combs may be used.

In use, the helmet is placed upon the head and the tabs 8 and 10 are fastened. The motor is switched on by the switch 25, and the tensioning screw 34 turned to adjust the belt tension to a comfortable level. The hair should be brushed back before use to avoid tangling the hair in the comb part of the belt.

The batteries should have sufficient energy to run the belt for about 30 minutes. Should the user fall asleep without switching off the motor, the belt will slowly come to a halt as the batteries discharge. The batteries may then be recharged or replaced upon waking.

This invention will be effective against the usual insomnia due to tension. It should not be used in cases of insomnia caused by cardiac conditions, drug overdoses or addictions, chronic pain, mental disorders, or other serious diseases. These should be treated by a physician.

It is to be understood that the present invention is not limited to the sole embodiment described above, but encompasses any and all embodiments within the scope of the following claims.

I claim:

1. A massaging helmet comprising;

a shell having a forward edge adapted to be worn adjacent a user's forehead and a rear edge adapted to be worn adjacent the rear of a user's head juxtaposed the back of the user's neck, retention means for fastening said shell to the head of a user, front and rear rollers mounted within said shell and having their axes of rotation normal to the plane of symmetry of the head of the user, said front roller disposed adjacent said shell forward edge and said rear roller disposed adjacent said shell rear edge, an endless unitary belt having an inner surface sheaved about and spanning said front and rear rollers, an outer surface on said endless belt engageable with the scalp of a user, adjustment means connected to at least one said roller and operable to vary the distance between said front and rear rollers to alter the configuration of said belt spanning said rollers, and a motor connected to one of said rollers, whereby upon operation of said motor said at least one roller is driven and said belt is moved between said rollers with said belt outer surface being moved over and massaging the scalp of the user.

2. A massaging helmet according to claim 1 wherein, operation of said motor displaces a portion of said belt outer surface juxtaposed the user's scalp in a direction from the front of the user's scalp to the rear thereof.

3. A massaging helmet according to claim 1 wherein, said adjustment means is connected to said rear roller.

4. A massaging helmet according to claim 1 including, electric power means joined to said motor, and said power means including a battery and switch.

5. A helmet as in claim 1 wherein said outer surface of said belt includes a plurality of contiguous regions of differing respective textures, said textures producing various distinct tactile sensations on the skin.

6. A helmet as in claim 1 wherein said retention means includes a chin strap and a headband, said chin strap and said headband both adjustable in length for securing said helmet to the user's head.

7. A messaging helmet according to claim 1 wherein, said belt inner surface includes transverse ridges having planar surfaces disposed at two different alternating angles to said inner surface, said roller connected to said motor having longitudinal ridges thereon, and said longitudinal ridges meshing with said transverse ridges, whereby a positive engagement is maintained between said roller connected to said motor and said belt inner surface.

8. A massaging helmet comprising:

fastening means for fastening said helmet to the head of a user;

roller disposed within said helmet;

an endless belt having an inner surface adapted to grip said rollers and an outer surface adapted to massage the head of the user, said belt disposed over said rollers so that said outer surface engages the scalp of the user;

said outer surface of said belt including a plurality of contiguous regions of varying texture, said regions including an embossed region resembling the surface of the human hand and a comb region having a plurality of elongated fingers extending normal to said outer surface;

a motor connected to one of said rollers for rotating said one roller; and electric power means connected to said motor for powering said motor; whereby when said motor is powered, said outer surface of said belt moves over the scalp of the user and massages the user's head, causing relaxation in the user, and whereby the scalp of the user is alternately massaged and combed.

9. A helmet as in claim 8 wherein said comb region occupies substantially two thirds of the area of said outer surface and said embossed region occupies substantially one third of the area of said outer surface.

10. A helmet as in claim 8 wherein said fingers have rounded ends distal said outer surface.

11. A massaging helmet comprising;

a shell having a forward edge adapted to be worn adjacent a user's forehead and a rear edge adapted to be worn adjacent the rear of a user's head juxtaposed the back of the user's neck, retention means for fastening said shell to the head of a user, frame means joined to said retention means and said shell, hinge means connecting said shell to said frame means, front and rear rollers mounted within said shell and having their axes of rotation normal to the plane of symmetry of the head of the user, said front roller disposed adjacent said shell forward edge and said rear roller disposed adjacent said shell rear edge, an endless unitary belt having an inner surface sheaved about and spanning said front and rear rollers, an outer surface on said endless belt engageable with the scalp of a user, adjustment means connected to at least one said roller and operable to vary the distance between said front and rear rollers to alter the configuration of said belt spanning said rollers, and a motor connected to one of said rollers, whereby upon operation of said motor said at least one roller is driven and said belt is moved between said rollers with said belt outer surface being moved over and massaging the scalp of the user, and whereby said shell is displaceable about said hinge means to expose said belt and motor.

* * * * *